US006526685B2

(12) United States Patent
Tippmann, Jr.

(10) Patent No.: US 6,526,685 B2
(45) **Date of Patent: *Mar. 4, 2003**

(54) PAINT BALL GUN

(75) Inventor: Dennis J. Tippmann, Jr., Fort Wayne, IN (US)

(73) Assignee: Tippmann Pneumatics, Inc., Fort Wayne, IN (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/005,055

(22) Filed: Dec. 4, 2001

(65) Prior Publication Data

US 2002/0040543 A1 Apr. 11, 2002

Related U.S. Application Data

(63) Continuation of application No. 09/333,083, filed on Jun. 14, 1999, now Pat. No. 6,324,779.

(51) Int. Cl.[7] ..... F41A 21/00
(52) U.S. Cl. ..... 42/76.01
(58) Field of Search ..... 42/76.01, 54, 57, 42/58, 55, 1.14, 1.08

(56) References Cited

U.S. PATENT DOCUMENTS

| | | | |
|---|---|---|---|
| 328,713 | A | 10/1885 | Petty |
| 1,187,218 | A | 6/1916 | Wister |
| 1,348,987 | A | 8/1920 | Fischer |
| 3,329,063 | A | 7/1967 | Ehrenburg et al. |
| 3,610,222 | A | 10/1971 | Hartman |
| 4,250,862 | A | 2/1981 | Speer |
| 4,345,578 | A | 8/1982 | Speer |
| 5,450,838 | A | 9/1995 | Nakahigashi et al. |
| 5,640,945 | A | 6/1997 | Slonaker et al. |
| 5,655,510 | A | 8/1997 | Kunimoto |

OTHER PUBLICATIONS

*Popular Science*, "New Gun Shoots Around Corners," Mar., 1952.

*Primary Examiner*—Charles T. Jordan
*Assistant Examiner*—Jordan M Lofdahl
(74) *Attorney, Agent, or Firm*—Barnes & Thornburg

(57) ABSTRACT

A paint ball gun is provided. The paint ball gun has a curved bore and a fluid actuated firing mechanism. The fluid actuated firing mechanism is in operable communication with the curved bore such that the fluid actuated firing mechanism propels the paint ball through the curved bore.

13 Claims, 5 Drawing Sheets

PAINT BALL GUN

RELATED APPLICATIONS

The present application is a Continuation of U.S. patent application, Ser. No. 09/333,083 (filed Jun. 14, 1999) now U.S. Pat. No. 6,324,779, entitled Gun Having a Curved Barrel. To the extent not included below, the subject matter disclosed in that application is hereby expressly incorporated into the present application.

TECHNICAL FIELD

The present invention relates generally to paint ball guns. More particularly, the present invention is directed to a paint ball gun having a curved bore that applies a spin onto a frangible, generally spherical projectile, like a paint ball, without causing the paint ball to rupture.

BACKGROUND AND SUMMARY

A variety of guns for firing frangible, generally spherical projectiles are known in the art. Marking guns, (commonly referred to as paint ball guns) for example, use pressure from compressed gas, such as nitrogen or carbon dioxide, to fire a gelatinous capsule containing. a marking material (usually paint). The capsule breaks on impact with a target dispersing the material, thereby marking the target. A popular recreational use for marking guns is in "survival games," a kind of mock war where opposing sides attempt to seek out and "shoot" one another with paint balls. Paint ball guns have also been used to segregate cattle within a herd and for a variety of other marking purposes.

Paint balls fired from such guns may have a limited trajectory because of the flight characteristics imposed on them by the amount of force that can be applied and by the configuration of the bore. In some applications, restrictions may exist on the velocity with which the ball may be expelled from the barrel. Consequently, there is a need for a gun that can affect the trajectory of the paint ball by changing its flight characteristics through changes in the gun bore, rather than by increases in force applied to the ball.

Accordingly, an illustrative embodiment disclosed herein provides a paint ball gun of the type configured to fire a paint ball. The paint ball gun comprises a curved bore and a fluid actuated firing mechanism. The fluid actuated firing mechanism is in operable communication with the curved bore such that the fluid actuated firing mechanism propels the paint ball through the curved bore.

Other illustrative embodiments may include the fluid actuated firing mechanism having a directional axis of firing, the curved bore imparting a spin on the paint ball, the paint ball exiting the bore in a direction substantially parallel to the directional axis of firing, and the bore being connected to the fluid actuated firing mechanism at an angle substantially non-perpendicular to the fluid actuated firing mechanism. In addition, a shroud may be provided to mask at least a portion of the paint ball gun.

Another illustrative embodiment disclosed herein also provides a paint ball gun configured to fire a paint ball. This embodiment of the paint ball gun comprises a body, a firing mechanism and a barrel. The firing mechanism is attached to the body. The barrel has a breech end and a muzzle end with a bore extending longitudinally therebetween. The breech end is in communication with the firing mechanism. The bore is curved so as to impart a spin to the paint ball while it is traveling there through.

Other illustrative embodiments may include the body having a directional axis of firing, and the paint ball exiting the bore in a direction substantially parallel to that directional axis. Furthermore, the bore may be connected to the firing mechanism at an angle substantially non-perpendicular to the firing mechanism.

Another illustrative embodiment disclosed herein, too, provides a paint ball gun configured to fire a paint ball. This embodiment, too, comprises a body, a firing mechanism, and a barrel. The body includes a directional axis of firing and the firing mechanism is attached to the body. The barrel has a breech end and a muzzle end with a bore extending longitudinally therebetween. The breech end is in communication with the firing mechanism. The bore is curved so as to impart a spin to the paint ball while it is traveling there through. The paint ball also exits the bore in a direction substantially parallel to the directional axis of firing.

Additional features and illustrative embodiments of the invention will become apparent to those skilled in the art upon consideration of the following detailed description exemplifying the best mode of carrying out the invention as presently perceived.

BRIEF DESCRIPTION OF DRAWINGS

The present invention will be described hereafter with reference to the attached drawings which are given as non-limiting examples only, in which.

Corresponding reference characters indicate corresponding parts throughout the several figures. The exemplification set out herein illustrates preferred embodiments of the invention and such exemplification is not to be construed as limiting the scope of the invention in any manner.

DETAILED DESCRIPTION OF THE DRAWINGS

The present invention relates generally to guns. More particularly, the present invention is directed to a gun having a slightly curved bore that applies a spin onto a frangible, generally spherical projectile without causing the projectile to rupture. The gun of the present invention may use any conventional force to expel the projectile from the bore. The gun may be of any conventional size and shape. In addition, the gun may provide for any conventional firing mechanism, as well as any generally spherical projectile.

The following description is but one embodiment of the curved bore air gun, and will be described with reference to FIGS. 1–5. While the described embodiments are considered by the inventor to be the best mode of carrying out the invention, it should be understood that the claims presented below are not limited to the particular details of the described embodiments. Numerous variations may be readily apparent to those of skill in the art which would provide for construction of the curved bore gas powered gun which incorporate the principles of the present invention as claimed.

Figure 1:
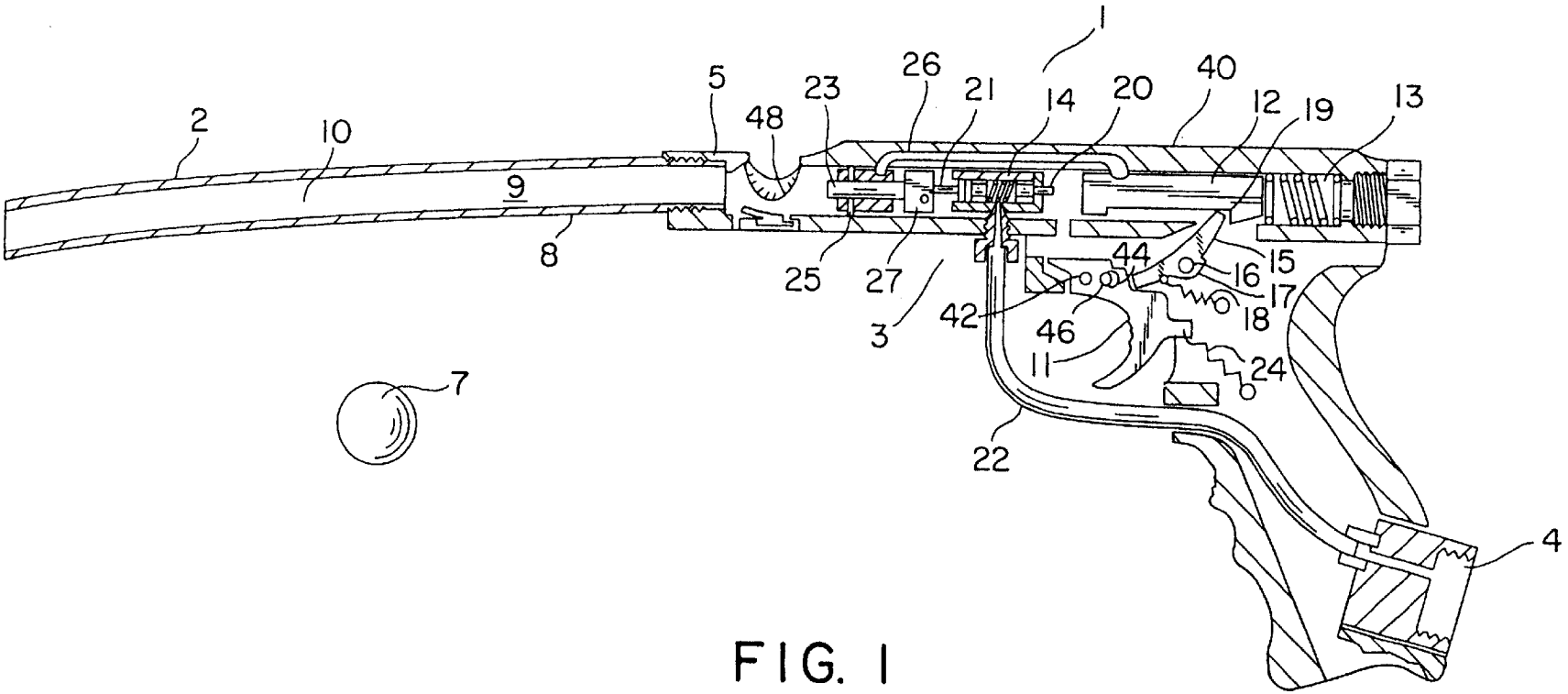
FIG. 1 is a cross-sectional, side-elevation view of a gas powered gun including one embodiment of the present invention.

Gun 1, shown in FIG. 1, comprises three major assemblies: a barrel 2, a firing mechanism 3, and a propellant source means (e.g., gas source inlet 4).

Barrel 2 comprises a breech end 5 and a muzzle end 6. Breech end 5 of barrel 2 attaches to firing mechanism 3. Muzzle end 6 of barrel 2 expels a frangible, generally spherical projectile 7 when gun 1 is fired. (See, also, FIG. 2.) A bore 8 is formed along the longitudinal extent 9 of barrel 2. Bore 8 creates a slightly curved path 10 along the longitudinal extent 9 of barrel 2. In one illustrative embodiment, bore 8 is curved through barrel 2 which is itself curved. Illustratively, a slightly curved path may be bored through a substantially straight barrel. In either case, gun bore 8 should have a generally large radius of curvature of about 40 inches to about 60 inches. Illustratively, the barrel may have about a 51½ inch radius. In addition, muzzle 6 is, illustratively, perpendicular to the radius of curvature of bore 8.

Figure 4:
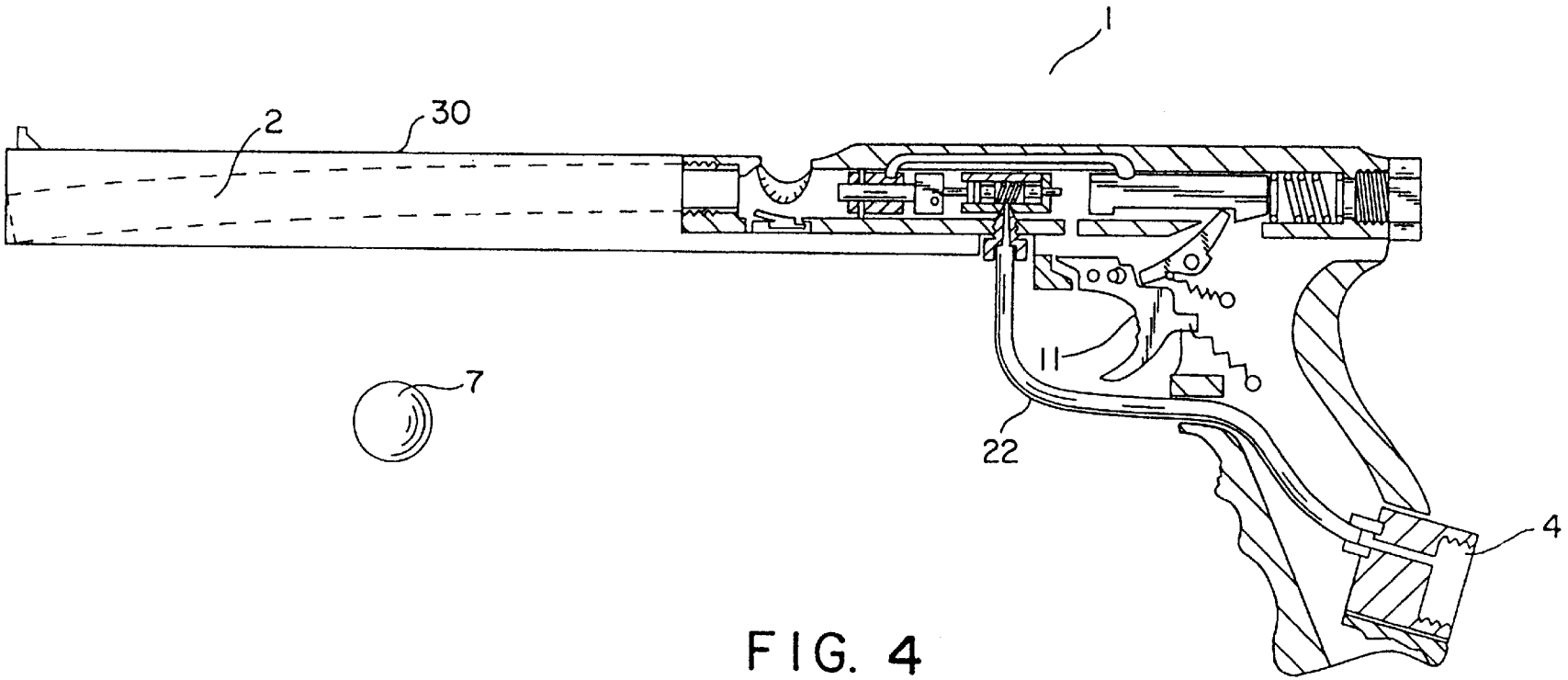
FIG. 4 is a cross-sectional, side elevation view of another embodiment of a gas powered gun.

Barrel 2 is connectable to a body 40, illustratively, by a series of threads, as best shown in FIG. 4. It is appreciated, however, that barrel 2 may be connected to body 40 by any variety of conventional ways. For example, the barrel may be lock-fit, friction fit, or even be an integral part of body 40. In addition, breech end 5 might be angled to affect the direction projectile 7 travels once it leaves muzzle end 6. (See, also, FIG. 5.)

Body 40 is configured to house all the components of firing mechanism 3. Any conventional firing mechanism may be used to fire the projectile through bore 8. Illustratively, firing mechanism 3 comprises a trigger 11 which is user actuable, and a recoil slide 12 which is movable under the bias of a spring 13 upon actuation of trigger 11. Firing mechanism 3 also comprises a valve assembly 14, illustratively, actuable by slide impact to selectively release a quantity of compressed gas, thereby causing the force to expel frangible, generally spherical projectile 7 through bore 8. It will be appreciated that valve assembly 14 may be replaced with any comparable assembly that selectively releases a quantity of gas to force the expulsion of generally spherical projectile 7 through bore 8.

Gas inlet 4 is designed to receive any variety of sources of gas. For example, inlet 4 may be configured to connect directly to a compressed gas tank or a canister. Or, inlet 4 may connect to a hose which also connects to a gas source. Either way, gas inlet 4 is interposed between the gas source (not shown) and valve assembly 14. Gas inlet 4 supplies gas to valve assembly 14, illustratively, by way of a hollow trigger guard tube 22 connectable to both.

Trigger 11 is attached to housing 40 by pivot pin 42, and has an allowable range of movement defined by elongated aperture 44 and pin 46, and the bias of spring 24. The illustrative range of movement extends to that of a typically pulled trigger. A pivotable lever 15 is interposed between trigger 11 and recoil slide 12. Lever 15 has a hole 16 disposed therethrough which is slightly elongated about its axis of rotation and which receives pivot pin 17. Lever 15 is biased by spring 18 in a counterclockwise direction about pin 17 so that lever 15 catches notch 19 in recoil slide 12, holding recoil slide 12 in its rearward or "cocked" position ready to fire. Discharge of gun 1 is caused by actuation of trigger 4. When trigger 11 is pulled, as shown by the hatched outline of trigger 11, elongated hole 16 allows lever 15 to migrate about pivot pin 17 and slip past the end of trigger 11, releasing slide 12.

Illustratively, recoil slide 12, projectile 7 (once it is placed in firing mechanism chamber 48), and valve assembly 14 are all axially aligned with the breech end 5 of barrel 2. Valve assembly 14 is positioned between projectile 7 and recoil slide 12, and is slightly movable along this common axis within predetermined limits. Valve assembly 14 receives the pressurized gas from hose 22. To release the gas, valve assembly 14 includes impact valves positioned at each axial end thereof First impact valve 20 faces recoil slide 12, and second impact valve 21 faces breech end 5. After recoil slide 12 is released, spring 13 biases recoil slide 12 toward impact valve 20. Shuttle 25, axially fitted about funnel 23 and connected to recoil slide 12 via connecting rod 26, moves projectile 7 into bore 8 just past breech end 5. As recoil slide 12 impacts valve 20, valve 20 opens slightly, causing a blow-back gas pressure, forcing recoil slide 12 back against spring 13. The recoil slide lever 15 catches notch 19 in recoil slide 12, holding it in its "cocked" position.

Force from recoil slide 12 impacting valve 20 not only causes that valve to open, but it also causes the entire valve assembly 14 to move slightly forward toward breech end 5. This forward movement causes impact valve 21 to engage a transverse bar 27 inside funnel 23 thereby slightly opening valve 21 and allowing the gas under pressure to expel through funnel 23. The force from this pressure propels projectile 7 through bore 8. It is appreciated that curved bore 8 may attach to any type of firing mechanism. This firing mechanism described is for illustrative purposes only. It is appreciated that any mechanism for accelerating the projectile may be used. For example, such mechanisms include nitrogen under pressure, ignited propane, oxygen, and/or butane, and springs.

Figure 2:
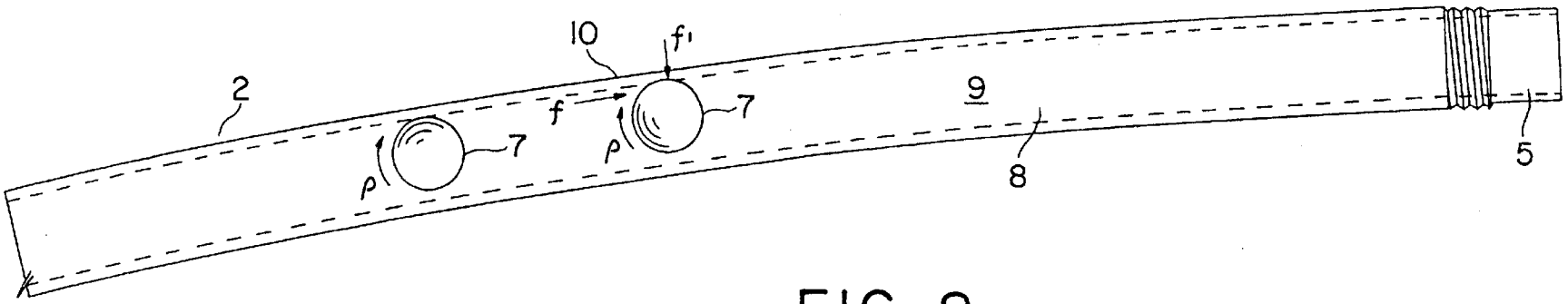
FIG. 2 is a cross-sectional, side-elevation view of a portion of the gas powered gun from FIG. 1.

The manner in which projectile 7 travels through bore 8 is best illustrated in FIG. 2. As projectile 7 travels through bore 8, it contacts a slightly curved path 10. Centripetal force acting on projectile 7 causes it to contact upper surface 28, creating friction f, imparting a rotational velocity ρ onto spherical projectile 7. This rotation ρ continues as a back-spin. Once projectile 7 exits barrel 2, the back-spin motion counteracts the force of gravity, creating substantially improved trajectory.

Frangible, generally spherical projectile 7 is typically a paint ball. Because these paint balls are designed to rupture on impact, they are usually relatively frangible. The slight curvature of the bore of the barrel is effective to back-spin the projectile, while not rupturing it prematurely. If the radius of curvature barrel 2 is too small, friction f or centripetal force f' acting on the ball may rupture projectile 7. As previously stated, an illustratively preferable radius of curvature for bore 8 is about 40 inches to about 60 inches.

Figure 3:
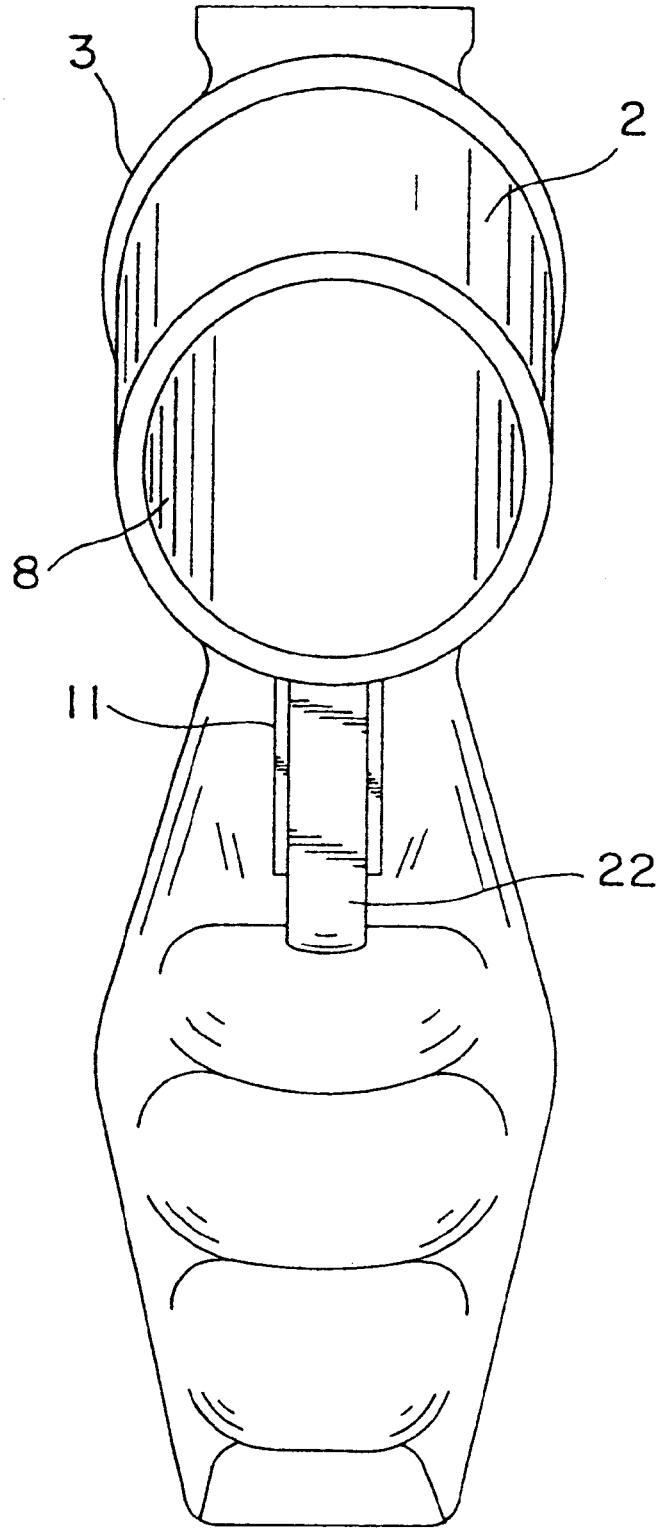
FIG. 3 is a front elevation view of a portion of the gas powered gun from FIG. 1.

The extent of the curvature of bore 8 may be well appreciated, as shown in FIG. 3. It will be appreciated that in one illustrative embodiment, the inner diameter of bore 8 remains substantially constant along its longitudinal extent 9. (See, also, FIG. 2.) The internal diameter of bore 8 is determined by the size of the paint ball or other projectile used. In one illustrative embodiment, the diameter of bore 8 may be sightly larger than the diameter of projectile 7. This is so that as projectile 7 propels through bore 8 and contacts upper surface 28, projectile 7 has sufficient clearance to rotate through bore 8 without interference by any other part of the bore. In addition, sufficient clearance, illustratively, includes taking into account any deformation that might occur to projectile 7 as it travels through bore 8.

Because a curved barrel may cause disorientation to an operator who is used to aiming a gun along a straight barrel, a shroud 30 may be fitted over barrel 2, as shown in FIG. 4. The operator, therefore, may now be able to aim along shroud 30 of gun 1 just as he/she would a straight barrel. The shroud 30 may be made from any myriad of materials, including aluminum, steel, plastic, or some type of fiberglass, for example. The shroud can also be configured in any myriad of ways so as to give the user of the gun the impression of a gun having a straight barrel.

Figure 5:
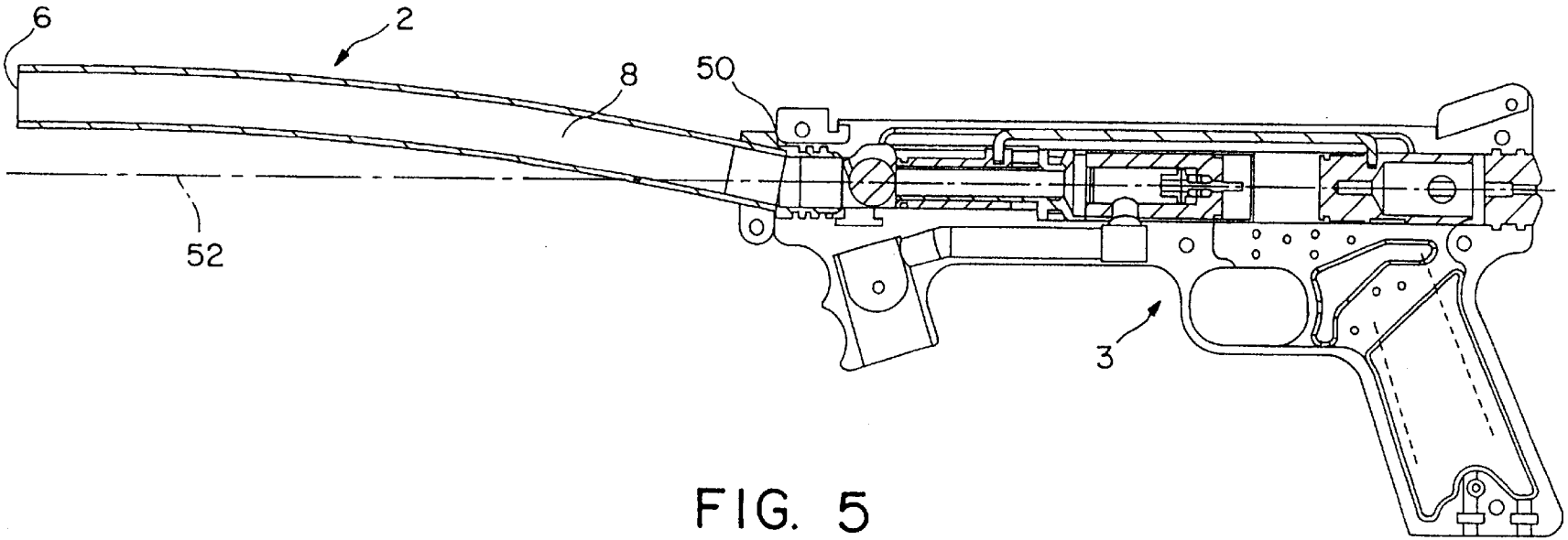
FIG. 5 is a cross-sectional, side-elevation view of a further embodiment of a gas powered gun.

In another illustrative embodiment, barrel 2, having curved bore 8, may be positioned at an angle relative to the firing mechanism such that muzzle end 6 is substantially perpendicular to longitudinal axis 52 of firing mechanism 3. Projectile 7 will exit muzzle 6, traveling along a path parallel to line 52. This is advantageous from the standpoint that projectile 7, as it is projected from muzzle 6, will travel in generally the same direction as gun 1 is pointing. Because of the aerodynamic effects spin creates, the projectile may have an improved trajectory when the gun is fired in a typical, upright orientation. When the gun is oriented in an alternative position (e.g., sideways), the spin causes the projectile to a laterally curved trajectory. Illustratively, the angle of muzzle 6 may be changed by changing the angle of breech end 5. An angled breech end 50, as shown in FIG. 5, affects the angle of muzzle end 6. (Compare to FIG. 1.) As a result, the changed angle of muzzle end 6 changes the angle with which article 7 exits bore 8. Furthermore, breech end 5 might be rotatably attached to firing mechanism 3 such that bore 8 may be selectively angled with respect to firing mechanism 3 along one or more axis to change the direction the ball shoots.

Traditional aiming means, like sights and scopes, may be attached to the gun embodying the present invention, just as they would other guns. For this present embodiment, the illustrative line of sight is preferably raised such that the line of sight be above muzzle end 6. In addition, it may be preferable to ensure the line of sight be perpendicular with muzzle end 6. This will ensure that projectile 7 will travel in the same general direction as the sight is aiming.

Although the present invention has been described with reference to particular means, materials and embodiments, from the foregoing description, one skilled in the art can easily ascertain the essential characteristics of the present invention and various changes and modifications may be made to adapt the various uses and characteristics without departing from the spirit and scope of the present invention as set forth in the following claims.

What is claimed is:

1. A paint ball gun of the type configured to fire a paint ball, the paint ball gun comprising:

a curved bore; and a fluid actuated firing mechanism in operable communication with the curved bore such that the fluid actuated firing mechanism propels the paint ball through the curved bore.

2. The paint ball gun of claim 1, wherein the fluid actuated firing mechanism has a directional axis of firing.

3. The paint ball gun of claim 1, wherein the curved bore imparts a spin on the paint ball as it is propelled therethrough.

4. The paint ball gun of claim 2, wherein the paint ball exits the bore in a direction substantially parallel to the directional axis of firing.

5. The paint ball gun of claim 1, wherein the bore is connected to the fluid actuated firing mechanism at an angle substantially non-perpendicular to the fluid actuated firing mechanism.

6. The paint ball gun of claim 1, further comprising a shroud to mask at least a portion of the paint ball gun.

7. A paint ball gun configured to fire a paint ball, the paint ball gun comprising:

a body;

a firing mechanism attached to the body; and a barrel having a breech end and a muzzle end with a bore extending longitudinally therebetween;

wherein the breech end is in communication with the firing mechanism; and wherein the bore is curved so as to impart a spin to the paint ball while traveling there through.

8. The paint ball gun of claim 7, wherein the body has a directional axis of firing.

9. The gun of claim 8, wherein the paint ball exits the bore in a direction substantially parallel to the directional axis of firing.

10. The gun of claim 7, wherein the bore is connected to the firing mechanism at an angle substantially non-perpendicular to the firing mechanism.

11. A gun comprising:

a frangible projectile;

a body having a directional axis of firing;

a firing mechanism attached to the body; and a barrel having a breech end and a muzzle end with a bore extending longitudinally therebetween;

wherein the breech end is in communication with the firing mechanism;

wherein the bore is curved so as to impart a spin to the frangible projectile while traveling there through; and wherein the frangible projectile exits the bore in a direction substantially parallel to the directional axis of firing.

12. The gun of claim 11, wherein the bore is connected to the firing mechanism at an angle substantially non-perpendicular to the firing mechanism.

13. A marking device comprising:

a frangible projectile configured to indicate a point of impact;

a curved bore;

a firing mechanism configured to locate the frangible projectile in operable communication with the curved bore; and a fluid power source to provide fluid to the firing mechanism;

wherein the firing mechanism with the fluid power source propels the frangible projectile through the curved bore.

* * * * *

UNITED STATES PATENT AND TRADEMARK OFFICE

CERTIFICATE OF CORRECTION

PATENT NO. : 6,526,685 B2
DATED : March 4, 2003
INVENTOR(S) : Dennis J. Tippmann, Jr.

It is certified that error appears in the above-identified patent and that said Letters Patent is hereby corrected as shown below:

Title page,
Item [56], References Cited, U.S. PATENT DOCUMENTS, add the following references:
-- US 4,073,280; 02/1978; Koehn et al.
US 6,324,779; 12/2001; Tippmann, Jr.
US 4,094,294; 06/1978; Speer
US 5,701,878; 12/1997; Moore et al. --

Signed and Sealed this

Twenty-first Day of June, 2005

JON W. DUDAS
*Director of the United States Patent and Trademark Office*